United States Patent [19]

Hayashi

[11] 4,370,841

[45] Feb. 1, 1983

[54] CONNECTOR ASSEMBLY

[75] Inventor: Moriyoshi Hayashi, Kurobe, Japan

[73] Assignee: Yoshida Kogyo K.K., Japan

[21] Appl. No.: 168,046

[22] Filed: Jul. 14, 1980

[30] Foreign Application Priority Data

Jul. 26, 1979 [JP] Japan ..... 54-103461[U]

[51] Int. Cl.[3] ..... E04C 1/34

[52] U.S. Cl. ..... 52/464; 52/727; 52/780

[58] Field of Search ..... 52/464, 772, 36, 509, 52/508, 780, 364, 483

[56] References Cited

U.S. PATENT DOCUMENTS

| | | | |
|---|---|---|---|
| Re. 30,432 | 11/1980 | Stoakes | 52/772 |
| 3,193,885 | 7/1965 | Gartner | 52/772 |
| 3,530,633 | 9/1970 | Scott | 52/464 |
| 3,732,659 | 5/1973 | Labarge | 52/464 |
| 3,848,364 | 11/1974 | Costruba | 52/36 |
| 4,163,350 | 8/1979 | Dogachi | 52/772 |

FOREIGN PATENT DOCUMENTS

| | | | |
|---|---|---|---|
| 468477 | 10/1950 | Canada | 52/509 |
| 2018340 | 10/1979 | United Kingdom | 52/509 |

*Primary Examiner*—Price C. Faw, Jr.
*Assistant Examiner*—Henry E. Raduazo
*Attorney, Agent, or Firm*—Robert E. Burns; Emmanuel J. Lobato; Bruce L. Adams

[57] ABSTRACT

A connector assembly comprising at least a pair of first members for connecting two panels edge to edge and to a building frame with a joint opening between such adjacent panel edges and a second member for covering the joint opening. Each of the first members includes a base having a first portion adapted to be held in a groove extending along the edge of a respective one of the panels and a second portion adapted to be secured to the buildingframe. Each first member further includes a retainer means formed on the second base portion integrally therewith and adapted to be disposed adjacent to one face of the joint opening that is to be covered. The second member has at least one leg extending into the retainer means and engageable therewith.

4 Claims, 5 Drawing Figures

CONNECTOR ASSEMBLY

BACKGROUND OF THE INVENTION

1. Field of the Invention

The present invention relates to connectors, and more particularly to a connector assembly for connecting adjacent panels edge to edge and to a building frame to assemble a wall or ceiling.

SUMMARY OF THE INVENTION

A primary object of the invention is to provide a connector assembly which enables easy assembling of a wall or ceiling.

Another object of the invention is to provide a connector assembly with which a joint opening between adjacent wall or ceiling panels, when assembled, can be covered nicely regardless of dimensional errors of the individual panels and/or joint opening.

According to the present invention, a connector assembly comprises at least a pair of first members for connecting two panels edge to edge and to a building frame with a joint opening, and a second member for covering the joint opening. Each of the first members includes a base having a first portion adapted to be secured to the building frame and a second portion adapted to be held in a groove extending along an edge of a respective one of the panels. Each first member such as extruded aluminum, and an elongated second member 12 made of a relatively rigid but slightly resilient synthetic resin such as polyvinyl chloride.

Figure 2:
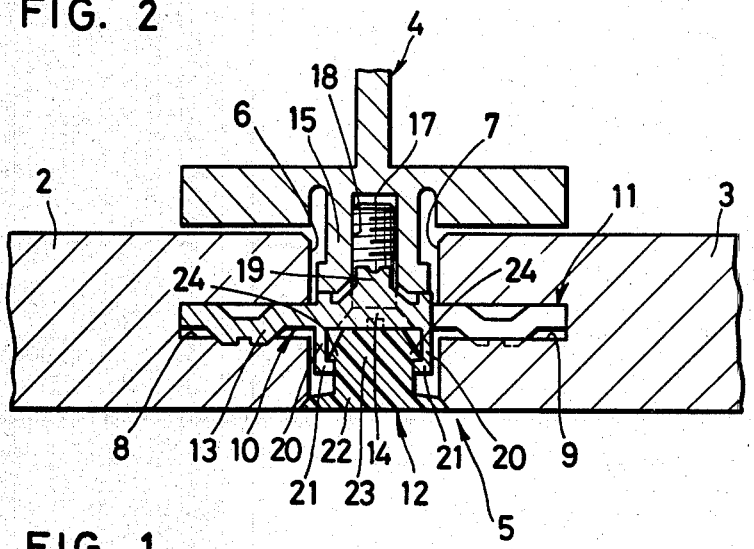
Figure 1:
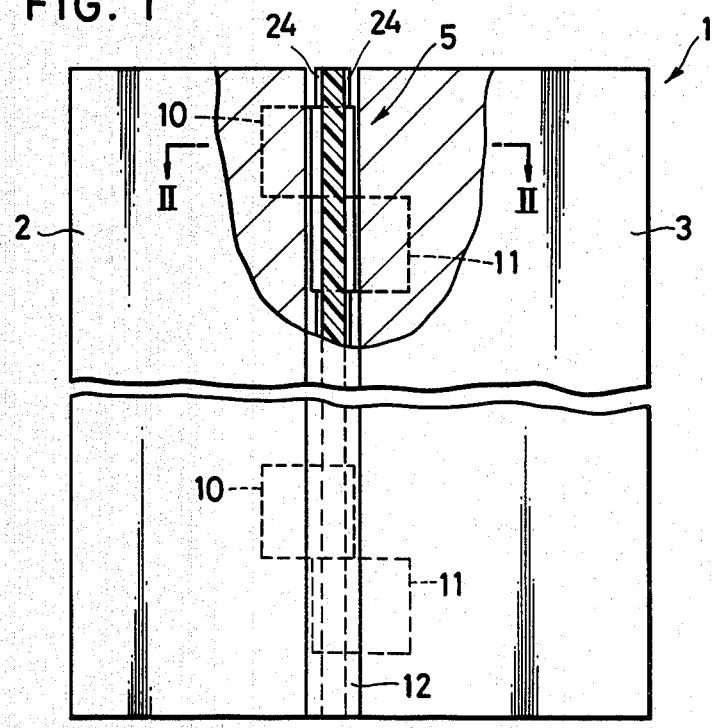
Figure 3:
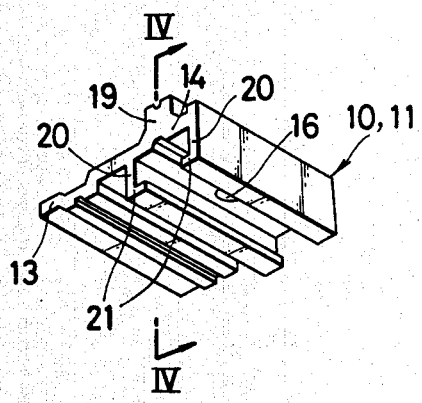
Figure 4:
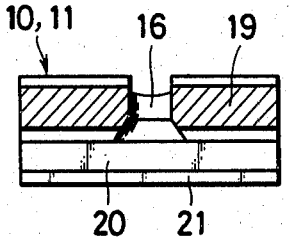

As shown in FIG. 2, each of the first members 10,11 includes a base having a first portion 13 fixedly received in the groove 8,9 of a respective one of the panels 2,3, and a second portion 14 secured to a portion 15 of the building frame 4 which portion extends into the joint opening from one face thereof. The second base portion 14 has a hole 16 (FIGS. 3 and 4) through which a fastening screw 17 loosely extends, the screw 17 extending threadedly into the building frame portion 15. Formed in the building frame portion 15 is a groove 18 having un-numbered threaded portions engaging the fastening screw 17. The second base portion 14 also has a projection 19 loosely extending into the groove 18. This projection 19 serves as a guide so that, when assembling, the hole 16 of the second base portion 14 can be easily and exactly aligned with the threaded portions of the groove 18 in the building frame portion 15.

Each first member 10,11 is further provided with a pair of parallel spaced arms 20,20 projecting from the second base portion 14 toward the other face of the joint opening and terminating in a pair of inwardly directed flanges 21,21, respectively. The arms 20 serve as a retainer means for the second member 12, as described below.

The second member 12 is elongate and has

At such corner the building frame 4 has a pair of grooves 28,28' so that the first members 10 attached to the panel 2 are at a right angle with respect to the first members 11 attached to the panel 3, when assembled. The modified second member 26 includes a base 27 generally of L-shaped transverse cross section and a pair of parallel spaced legs 29,30 projecting one from each arm of the "L" (27) into the joint opening and terminating in a pair of inwardly projecting protruberances 31,32, respectively. The protruberances 31,32 of the legs 29,30 on the second member 26 are in locking engagement with the flanges 21 of one of the opposed arms 20 on the first member 10 and that of the first member 11, respectively.

Figure 5:
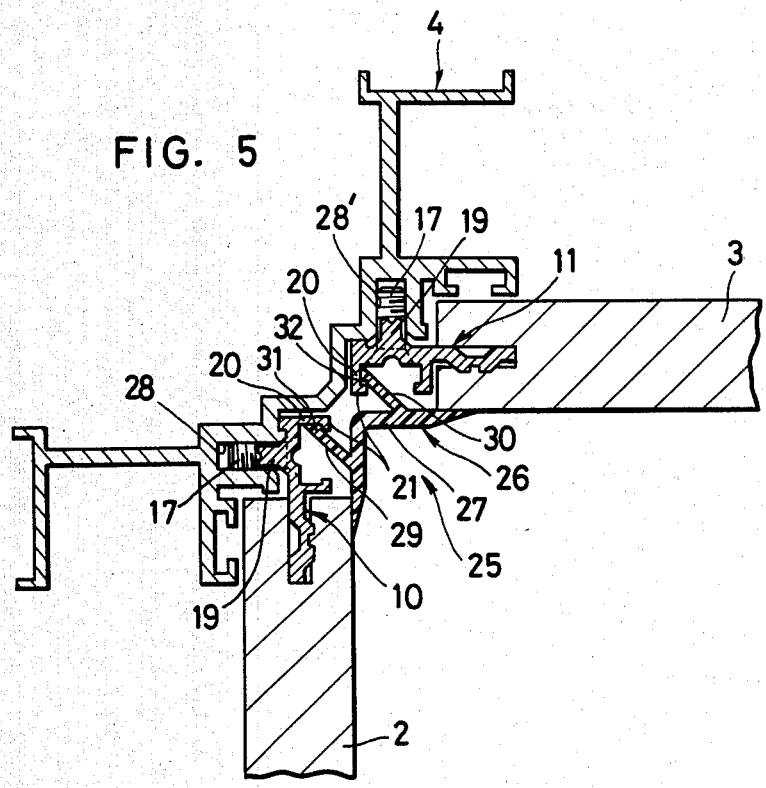

For assembly, the panels 2,3 are attached to the building frame 4 by means of the first members 10,11, respectively, as shown in FIG. 5. Then the second member 26 is applied to the joint opening with the arms of the L-shaped base 27 parallel to the respective panel faces and moved toward the building frame 4 until the protruberances 31,32 of the legs 29,30 on the second member 26 come into locking engagement with the flange 21 of one of the opposed arms 20 on the first members 10 and the flange 21 of one of the opposed arms 20 on the first member 11, respectively.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A connector assembly for connecting two adjacent panels edge to edge and to a building frame with a joint opening between such adjacent panel edges, each of the panels having a groove extending longitudinally along the edge thereof, the building frame having a portion disposed adjacent to one face of the joint opening, said connector assembly comprising:

(a) at least a pair of first members each including (1) a base having a single first portion adapted to be held in the groove of a respective one only of the panels and a second portion adapted to be secured to the portion of the building frame, said first portion of the base of one of said first members of a pair being received in said groove in one only of said adjacent panels and said first portion of the base of the other of said first members of a pair being received in said groove in the other of said adjacent panels only, and (2) retainer means formed on said second portion of said base integrally therewith and adapted to be disposed adjacent to the other face of the joint opening; and (b) a second member for covering the joint opening on the other face thereof, said second member having at least one leg extending into said retainer means on said second portion of the base of both of said first members of a pair and being retained thereby.

2. A connector assembly according to claim 1, in which said base of said each first member has in said second portion thereof a hole to receive a fastening screw extending threadedly into said portion of the building frame.

3. A connector assembly according to claim 1, in which said retainer means includes a pair of parallel spaced arms projecting from said second portion of said base toward said other face of the joint opening and terminating in a pair of inwardly directed flanges, respectively, said one leg of said second member terminating in at least one lateral protruberance engaging at least one of said pair of flanges to retain said leg between said spaced arms.

4. A connector assembly according to claim 2, in which each said first member has a projection on said second portion of said base for extending into a groove formed in said portion of the building frame, the last-named groove having threaded portions with which the fastener screw is threadedly engageable.

* * * * *